United States Patent [19]

Zalkauskas

[11] Patent Number: 4,772,237

[45] Date of Patent: Sep. 20, 1988

[54] PADDLE BOAT

[76] Inventor: Anthony Zalkauskas, 405 Dorchester Ct., Sunny Hills, Fla. 32428-9372

[21] Appl. No.: 66,216

[22] Filed: Jun. 25, 1987

[51] Int. Cl.[4] ..... B63H 1/34

[52] U.S. Cl. ..... 440/96; 440/30; 440/92

[58] Field of Search ..... 440/90–93, 440/98, 100, 95–97, 21, 26–30; 416/7, 8

[56] References Cited

U.S. PATENT DOCUMENTS

| | | | |
|---|---|---|---|
| 413,852 | 10/1889 | French | 416/8 |
| 1,777,749 | 10/1930 | Equiluz | 440/90 |
| 1,869,136 | 7/1932 | Farraguto | 440/93 |
| 2,980,054 | 4/1961 | Sanders | 440/93 |

FOREIGN PATENT DOCUMENTS

| | | |
|---|---|---|
| 113849 | 9/1941 | Australia . |
| 908519 | 4/1946 | France . |

*Primary Examiner*—Sherman D. Basinger

*Assistant Examiner*—Edwin L. Swinehart

*Attorney, Agent, or Firm*—Gifford, Groh, VanOphem, Sheridan, Sprinkle and Dolgorukov

[57] ABSTRACT

The present invention provides a paddle boat having a hull and a closed loop flexible member which is rotatably mounted to the hull while a pedal assembly longitudinally drives the flexible member around its loop. A plurality of substantially planar paddles are pivotally mounted to the flexible member at spaced positions therealong. The paddles are pivotal between a first and a second position. In the first position, the paddles extend outwardly from the flexible member and propel the hull forwardly as the flexible member is driven by the pedal assembly. Conversely, in its second position, the paddles lie in planes substantially parallel to the direction of travel of the flexible member to permit free gliding of the boat. However, a locking assembly is associated with at least one paddle to lock the paddle in its first position when the flexible member is driven in the reverse direction.

9 Claims, 2 Drawing Sheets

PADDLE BOAT

BACKGROUND OF THE INVENTION

I. Field of the Invention

The present invention relates generally to aquatic devices and, more particularly, to a paddle boat.

II. Description of the Prior Art

There are a number of previously known paddle boats and many of these previously known paddle boats are manually propelled. The manually propelled paddle boats typically comprise a hull having a plurality of paddles which depend downwardly from the hull and into the water. These paddles are driven by a person sitting in the hull so that the paddles propel the hull forwardly.

One disadvantage of these previously known paddle boats, however, it that the paddles remain in the water in a fixed position when the user stops propelling or driving the paddles. Consequently, the paddles, when stationary, inhibit the gliding action of the paddle boat and, indeed, act to break the forward movement of the paddle boat. Consequently, in order to maintain the forward motion of these previously known paddle boats, it is necessary to continuously pedal the boat which is tiring and detracts from the overall enjoyment of using the paddle boat.

There have, however, been some previously known paddle boats with pivotal paddles which allow the boat to glide even though pedalling stops. Unfortunately, these paddle boats cannot be effectively pedalled in the reverse direction.

SUMMARY OF THE PRESENT INVENTION

The present invention provides a paddle boat which overcomes all of the above mentioned disadvantages of the previously known devices.

In brief, the paddle boat of the present invention comprises a hull in which the user sits or is otherwise supported. A closed loop flexible member is rotatably mounted to the hull about two spaced pulleys. A paddle assembly is drivingly connected to one pulley so that, as the pedals are driven by the user, the driven pulley longitudinally drives the flexible member in a closed loop around the pulleys.

A plurality of generally planar paddles are pivotally mounted to the flexible member at spaced positions therealong. These paddles are pivotal between a first position, in which the paddles extend outwardly from the flexible member, and a second position, in which the paddles are parallel to and lie against the flexible member.

The pulleys are rotatably mounted to the hull so that, with the paddles in their first or outwardly extending position, at least one of the paddles depends downwardly from the flexible member and into the water. Consequently, as the paddles are rotatably driven by the user, the paddles engage the water and propel the hull in a forward direction. Conversely, when the user stops pedalling, the force of the water acting against the paddles, pivots the paddles up to their second position thus minimizing resistance between the paddles and the water and enabling the paddle boat to freely glide.

A locking assembly is associated with at least one paddle which locks the paddle in its first position when the paddle boat is reverse pedalled.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
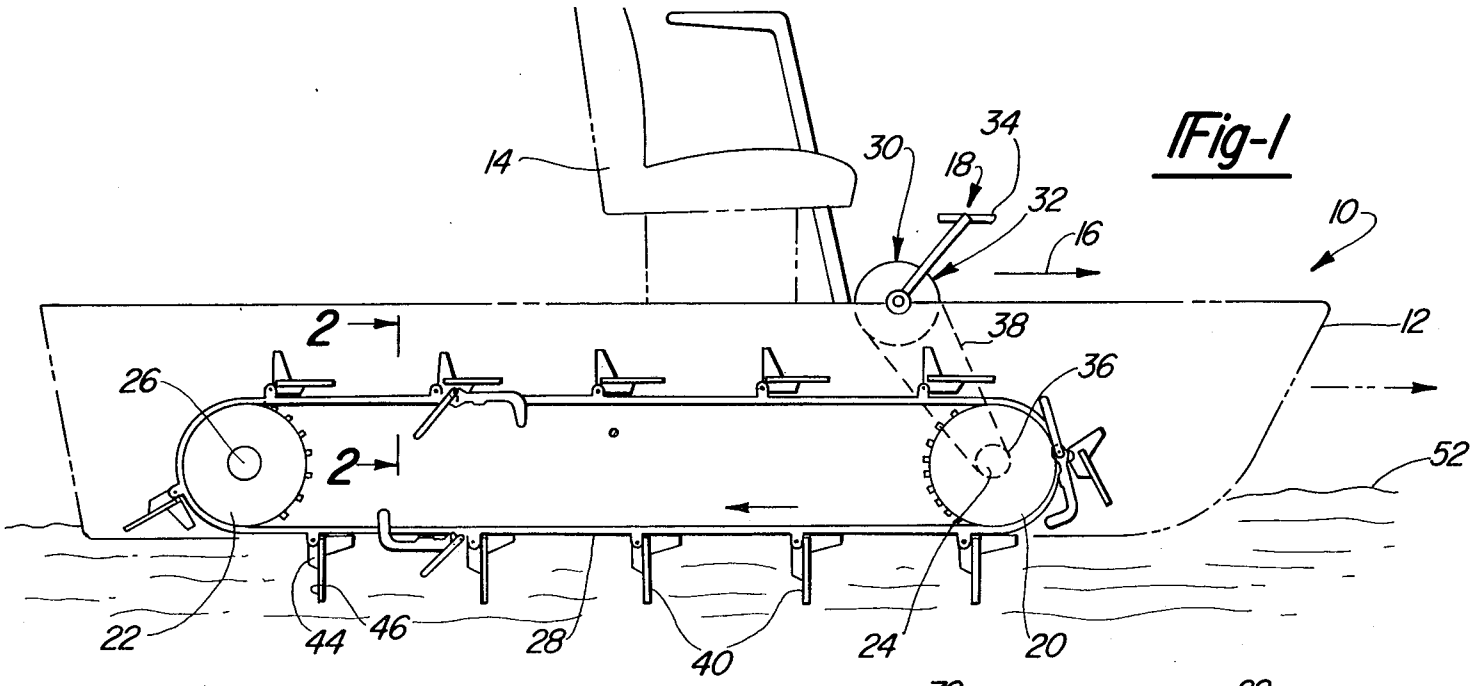
FIG. 1 is a side diagrammatic view illustrating a preferred embodiment of the present invention.

With reference first to FIG. 1, a preferred embodiment of the paddle boat 10 of the present invention is thereshown and comprises a hull 12 which may be of any conventional construction. The paddle boat 10 is adapted to be propelled in the direction indicated by arrow 16 by a user supported in a seat 14.

Figure 2:
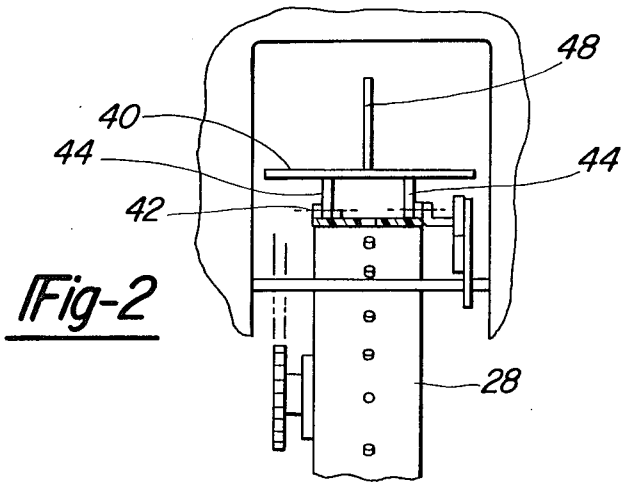
FIG. 2 is a fragmentary perspective view illustrating a portion of the preferred embodiment of the present invention.

With reference now to FIGS. 1 and 2, the paddle boat 10 includes a propulsion unit 18 which allows the user in the seat 14 to propel the paddle boat 10 in the forward direction as indicated by arrow 16 (FIG. 1). The propulsion unit includes a front wheel or pulley 20 and a rear wheel or pulley 22. The pulleys 20 and 22 are rotatably mounted to the hull 12 by axles 24 and 26, respectively, so that the pulleys 20 and 22 are longitudinally spaced from each other. In addition, as best shown in FIG. 1, the pulleys 20 and 22 are each rotatably mounted to the hull 12 about a horizontal axis extending transversely with respect to the hull 12.

With reference still to FIG. 1, an elongated closed loop flexible member or band 28 extends around the pulleys 20 and 22 so that rotation of either pulley 20 or 22 longitudinally drives the band 28. Although any conventional means can be used to rotatably drive the pulley 20 or 22, preferably a conventional pedal assembly 30 is rotatably mounted to the hull 12 at a position accessible to the users feet while supported in the seat 14. This pedal assembly 30 includes a drive sprocket 32 which is rotatably driven in unison with one or more pedals 34. The drive sprocket 32 is drivingly connected to a driven sprocket 36 on the pulley axle 24 by a chain 38 or the like. Consequently, as the pedals 34 are rotatably driven by the user, the band 28 is longitudinally driven around its closed loop.

Figure 4:
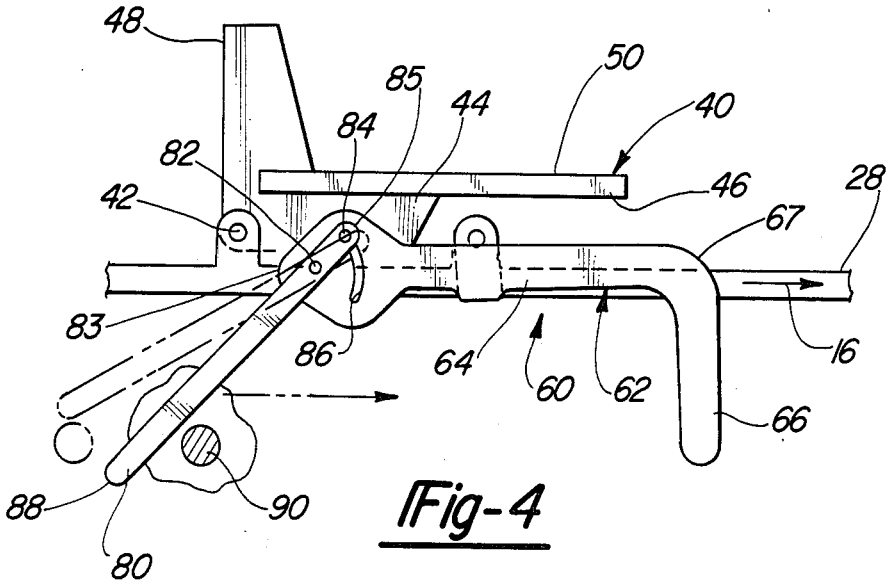
FIG. 4 is a fragmentary side view of a portion of the preferred embodiment of the present invention.
Figure 5:
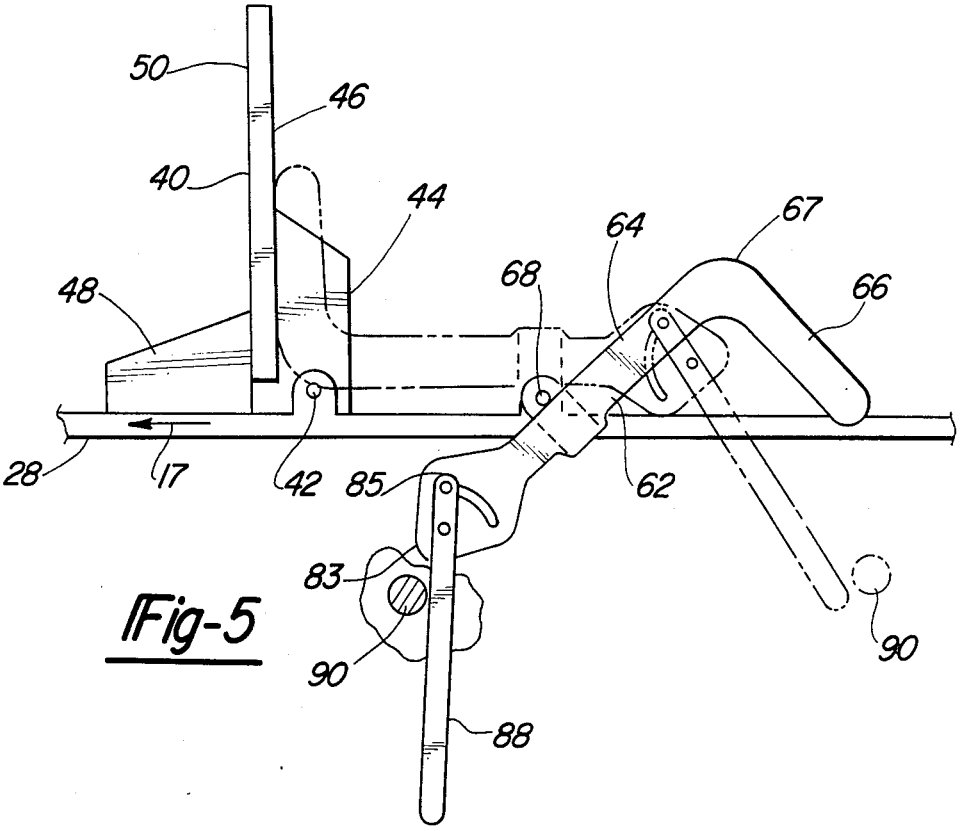
FIG. 5 is a fragmentary side view of a portion of the preferred embodiment of the present invention.

With reference to FIGS. 1, 2 and 5, a plurality of generally planar paddles 40 are pivotally secured to the band 28 at spaced positions therealong by any conventional means, such as a pivot pin 42. The pivot pin 42 preferably is pivotally attached to two reinforcing ribs 44 attached to one side 46 of the paddle 40 and allow the paddle 40 to pivot between a first position, illustrated in solid line in FIG. 5 and a second position, illustrated in FIG. 4. A stop 48 is attached to the opposite side 50 of the paddle 40 which abuts against the band 28 when the paddle 40 is in its first position. Consequently, the stop 48 limits the pivotal travel between the first and second position which are approximately 90° from each other.

With reference now particularly to FIG. 1, with the paddles 40 in their first position, the paddles 40 depend downwardly from the band 28 and below the water line 52 of the water body in which the paddle boat 10 is positioned. Consequently, as the pedals 34 are driven in a clockwise direction, as viewed in FIG. 1, the paddles 40 on the lower portion of the band 28 are driven rearwardly with respect to the hull 12 and thus propel the paddle boat 10 forwardly in the direction of arrow 16. The paddles 40, or at least the paddles 40 on the lower half of the band 28, will remain in their downward position as long as the pedals 34 are rotatably driven in order to propel the paddle boat 10 in the desired fashion.

Assuming that the paddle boat 10 is moving in the forward direction, when the user stops pedalling the pedals 34 so that the band 28 remains stationary or travels at a slower speed than the speed of the paddle boat 10, the force of the water acting on the submerged paddles 40 in the direction opposite from the direction of travel of the paddle boat 10 causes the paddles 40 to pivot to their second position as shown in FIGS. 2 and 4. In doing so, the plane of each paddle 40 is generally parallel to the direction of travel of the paddle boat 10 thus minimizing resistance between the paddles 40 and the water. By thus minimizing the resistance between the paddles 40 and the water, the paddle boat 10 freely glides forward even when the user stops pedalling the pedals 34.

One disadvantage of pivotally mounting all of the paddles 40 to the band 28 as previously described is that if the pedals 34 are back pedalled, i.e. pedalled in the counterclockwise direction as viewed in FIG. 1, the pedals 34 simply pivot the their flat second position, as shown in FIG. 4. Consequently, little or no reverse propulsion is normally obtained by back pedalling the pedals 34.

Figure 3:
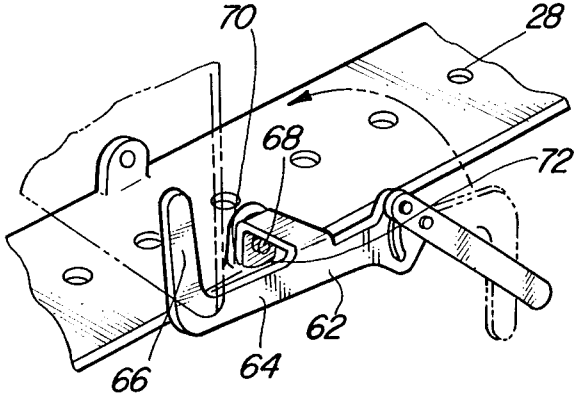
FIG. 3 is a fragmentary side view of a portion of the preferred embodiment of the present invention and enlarged for clarity.

With reference now to FIGS. 3–5, in order to allow back pedalling of the pedals 34 for reverse propulsion, a locking assembly 60 is associated with at least one paddle 40 and preferably at least one locking assembly 60 is associated with a plurality of paddles 40 at spaced intervals along the band 28. Only one locking assembly 60 will be described in detail, it being understood that a like description shall also apply to the other locking assembly 60.

Still referring to FIGS. 3–5, the locking assembly 60 comprises an elongated lever 62 having a first elongated leg 64 and a second leg 66 extending perpendicularly outwardly from one end 67 of the leg 64.

The leg 64 is pivotally mounted by a pivot pin 68 to the band 28 adjacent the paddle 40. Furthermore, the pivot pin 68 allows the lever 62 to pivot about an axis transverse to the band 28 between a first or free gliding position illustrated in FIG. 4 and a second or locked position illustrated in FIG. 3 and also illustrated in phantom line in FIG. 5.

With the lever 62 in its free gliding position (FIG. 4), the paddle 40 freely pivots between its first and second position to allow both forward propulsion and free gliding of the paddle boat 10 in the fashion previously described. Conversely, with the lever 62 in its second or locked position as illustrated in phantom line in FIG. 5, the perpendicular leg 66 of the lever 62 abuts against the side 46 of the paddle 40 and thus locks the paddle 40 in its first position in which the paddle 40 extends perpendicularly outwardly from the band 28 in order to provide reverse propulsion.

As best shown in FIG. 3, an appropriate stop 70 is preferably provided at the pivotal connection between the lever 62 and the band 28 in order to limit the pivotal action of the lever 62 between its gliding position (FIG. 4) and locking position (FIG. 3). Similarly, a spring 72 (illustrated only diagrammatically) urges the lever 62 towards either its gliding or locking position and prevents the lever 62 from remaining at a position intermediate its locking and gliding position.

With reference now to FIG. 5, in order to actuate the lever 62, i.e. to move the lever between its gliding position and its locking position, an actuating lever or bar 80 is pivotally mounted by a pin 82 to the end 83 of the lever leg 64 opposite from the leg 66. A stop pin 84 is slidably received within an arcuate slot 86 in the lever leg 64 and allows the actuating lever 80 to pivot between the positions shown in FIGS. 3 and 4. The weight of the actuating lever leg 80, however, will maintain the lever 80 in a downwardly depending position since the length of the lever between the pivot pin 82 and its free end 88 is greater than the distance between the pivot pin 82 and the other end 85 of the lever 80.

The actuating lever 80 cooperates with a cross bar 90 which is stationarily secured to the boat hull 12. As best shown in FIG. 4, assuming that the locking lever 62 is in its gliding position as shown in FIG. 4 and that the band 28 is driven in a forward direction, the locking lever 62 remains in its gliding position and the actuating lever 80 merely passes over the actuating bar 90 as shown in phantom line.

Conversely, with reference to FIG. 5, assuming that the band 28 is driven in the reverse direction as shown by arrow 17, the actuating lever 80 contacts the bar 90 and pivots the lever leg 64 in a counterclockwise direction from the position shown in FIG. 4, to the position shown in solid line in FIG. 5 and, ultimately, to the position shown in phantom line in FIG. 5. With the lever leg 64 in the position shown in phantom line in FIG. 5, the leg 66 of the lever 62 abuts against the side 46 of the paddle 40 and locks the paddle 40 in its outwardly extending or first position. Thus, upon the continued reverse pedalling of the paddle boat 10 so that the band 28 is driven in the direction of arrow 17, the lever leg 64 prevents the paddle 40 from pivotting to its gliding position (FIG. 4) and thus allows reverse propulsion of the paddle boat 10 by pedalling in the reverse direction.

After the paddle boat 10 has been pedalled in the reverse direction and the forward pedalling is again assumed, the actuating bar 80 (phantom line in FIG. 5) again contacts the lever and pivots the lever in the clockwise direction to the position shown in FIG. 4 which again allows the paddle to resume its gliding position as the boat glides through the water.

From the foregoing, it can be seen that the paddle boat of the present invention provides a paddle boat which allows free gliding of the paddle boat but which still allows the paddle boat to be propelled in the reverse direction when desired.

Having described my invention, however, many modifications thereto will become apparent to those having ordinary skill in the art without deviation from the spirit or scope of the invention.

I claim:

1. A paddle boat comprising:

a hull, a closed loop flexible member, means for rotatably mounting said flexible member to said hull, means for rotatably driving said flexible member in a first rotatable direction, a plurality of substantially planar paddles, means for pivotally mounting said paddles to said flexible member at spaced positions therealong, said paddles being pivotal between a first position in which said paddles extend outwardly from said flexible member and propel said hull in a predetermined direction as said member is driven in one direction, and a second position in which said paddles lie in a plane substantially parallel to said predetermined direction, wherein a force on said paddles opposite in direction than said predetermined direction pivots said paddles from said first and towards said second position, means movable between a locked and glide position for selectively locking at least one paddle in said first position, means responsive to movement of said flexible member in a second rotatable direction opposite from said first rotatable direction for actuating said locking means from said glide and to said locked position, and wherein said selective locking means comprises a lever pivotally mounted to said flexible member, said lever being pivotal between said glide position in which at least one paddle is freely pivotal between said first and second position, and said locked position in which a portion of said lever abuts against said at least one paddle and locks said at least one paddle in said first position.

2. The invention as defined in claim 1 wherein said rotatable mounting means comprises a pair of pulleys, said pulleys being spaced apart from each other, and said flexible member extending around said pulleys.

3. The invention as defined in claim 1, wherein said actuating means comprises an actuating bar pivotally mounted to said lever, said actuating bar cooperating with a cross bar stationarily secured to said hull.

4. The invention as defined in claim 3 wherein said lever comprises a first leg pivotally mounted at a midpoint to said flexible member, a second leg extending substantially perpendicularly outwardly from one end of said first leg, and wherein said actuating bar is secured to the end of said first leg opposite from said second leg.

5. The invention as defined in claim 1 wherein said paddles are freely pivotally mounted to said flexible member.

6. The invention as defined in claim 1 wherein said flexible member comprises a band.

7. The invention as defined in claim 1 and comprising a stop secured to each said paddle which abuts against said flexible member when said paddle is in said first position.

8. The invention as defined in claim 5 wherein said driving means comprises means for rotatably driving one of said pulleys.

9. The invention as defined in claim 6 wherein said driving means comprises a pair of pedals

* * * * *